United States Patent [19]

Ryan

[11] 4,019,122

[45] Apr. 19, 1977

[54] STABILIZED POWER SUPPLIES

[75] Inventor: Kenneth Augustine Ryan, Wishaw, Scotland

[73] Assignee: Telcon-Magnetic Cores Limited, England

[22] Filed: Aug. 7, 1975

[21] Appl. No.: 602,511

[30] Foreign Application Priority Data

Aug. 14, 1974 United Kingdom ..... 35766/74
Feb. 20, 1975 United Kingdom ..... 7176/75

[52] U.S. Cl. ..... 323/60; 336/165; 336/178; 336/184; 336/215

[51] Int. Cl.[2] ..... G05F 3/06

[58] Field of Search ..... 323/6, 44 R, 48, 60, 323/61; 336/165, 178, 184, 212, 215

[56] References Cited

UNITED STATES PATENTS

| | | | |
|---|---|---|---|
| 1,599,570 | 9/1926 | Lucas | 323/60 |
| 2,738,458 | 3/1956 | Walsh | 323/61 |
| 2,973,470 | 2/1961 | Kohn | 323/60 |
| 3,170,133 | 2/1965 | Kernick | 336/165 |
| 3,247,450 | 4/1966 | Medlar | 323/60 |
| 3,708,744 | 1/1973 | Stephens et al. | 323/60 |

*Primary Examiner*—A. D. Pellinen
*Attorney, Agent, or Firm*—Buell, Blenko & Ziesenheim

[57] ABSTRACT

A constant-voltage transformer for stabilized power supply includes a primary coil and a secondary coil connected across a tuning capacitor. A magnetically continuous magnetic core links both the primary coil and the secondary coil, and a magnetically discontinuous magnetic core links the secondary coil but not the primary coil. Another discontinuous magnetic core may link the primary coil but not the secondary coil, and a compensating coil may be linked by this core only. Preferred designs have an abrupt cut-off at a load current only a little greater than design value, so that a dangerously high current can never be drawn, even into a total short circuit.

10 Claims, 7 Drawing Figures

STABILIZED POWER SUPPLIES

The invention relates to equipment for providing a stabilized alternating electrical supply having a smooth wave-form and relatively uniform voltage from the mains or another primary source that is subject to interference, wave-form distortion and/or voltage fluctuation, for example for supplying sensitive electronic equipment. More particularly it relates to apparatus of the kind in which a secondary coil forming part of a tuned inductance-capacitance circuit is coupled magnetically with a primary coil (connected to the primary source) in such a way as to produce in the tuned circuit an oscillating current that is large compared with any current directly induced in it from the primary. Such apparatus may be regarded as a stabilized transformer or as a pumped magnetic oscillator, but in the following description the term 'constant voltage transformer' will be used.

Conventional constant voltage transformers are based on stack-type laminated interleaved magnetic cores, usually having a central limb, on opposite ends of which the two coils are mounted, and two outer limbs connected to the central limb at each end by yoke portions; magnetic shunts interconnect the central limb with each of the outer limbs at a position between the two coils to provide the necessary shunt path, which is normally formed with an air gap ( or other non-magnetic gap ) the size of which considerably influences the output wave-form and determines the effective inductance in the resonant circuit.

In this form of apparatus the magnetic shunt gives the secondary coil substantial self-inductance permitting it to be tuned. The main magnetic circuit is designed to operate in its saturation region at the peaks of the magnetisation due to oscillating current in the secondary coil, and in this condition a substantial part of the primary flux is directed through the shunt, but in each of the two low-magnetization regions of the secondary wave-form this primary flux switches back to the low-reluctance main circuit, supplying a voltage pulse that maintains the oscillation, since the circuit is tuned to the supply frequencey.

This stack-type construction has a number of important disadvantages, notably

1. It cannot readily be adapted to use the more efficient grain-oriented magnetic strip material, since this has to be arranged in curved laminations following the magnetic-flux path.

2. The air gap in the two magnetic shunts has to be the same, and is difficult to adjust.

3. The areas of the two magnetic shunts cannot be adjusted independently of one another.

4. Each design and size requires its own lamination-stamping tools which are of no other use, and so setting up a new design (either to extend a range or to re-optimize copper: iron ratio consequent on relative price changes) is expensive.

Special designs based on U-shaped "half-cores" of curved grain-oriented laminations assembled in special configurations have been suggested, but these do not overcome the other laminations of the conventional design and have not been adopted on a commercial scale so far as the applicant is aware.

In accordance with the present invention, a constant voltage transformer comprises a primary coil, a secondary coil connected across a tuning capacitor, a magnetically continuous magnetic core linking both the primary coil and the secondary coil and a magnetically discontinuous magnetic core (the secondary shunt) linking the secondary coil but not the primary coil. Preferably another magnetically discontinuous magnetic core (the primary shunt) links the primary coil but not the secondary coil, but if only modest performance is required this can be dispensed with.

Preferably the discontinuous cores, or each of them are spaced sufficiently from the continuous core to avoid heating effects. Preferably both or all of the cores are formed of curved laminations of grain-oriented material (i.e., silicon-iron alloy). Simple 'C-type' cores comprising two C- or U-shaped parts butt-jointed together can be used and are preferred, with the parts closely butted to give magnetic continuity or butted on a spacer of appropriate thickness to form a discontinuous core. Preferably both joints of a discontinuous core are gapped in this way, avoiding any need for special shaping of the core parts. The continuous core could of course be uncut or formed with interleaved joints, but these alternatives are expensive and are not recommended.

Preferably the secondary coil is provided with several tappings to permit adjustment of output voltage. Preferably the primary and secondary coils are located on opposite legs (or limbs, but preferably legs) of the continuous magnetic core, and the or each discontinuous core is preferably located outside the continuous core. The cores may be and preferably are generally coplanar.

The output from the secondary coil of the constant-voltage transformer described has imperfections in the (1) its voltage rises slowly but appreciably with rising input voltage and (2) its voltage declines as the load-current increases. With stack-type core constant voltage transformers it has been the practice to modify the output by winding a relatively small coil (the 'bucking' coil) on the same limb as the primary coil and connected in series opposition with the secondary coil, the number of turns being chosen to compensate the first of these imperfections.

This technique can be used in the transformer of the present invention if desired but it has now been found that more efficient voltage compensation can be obtained and the other imperfection simultaneously alleviated in those transformers in accordance with the invention that have a primary shunt core by linking a compensating coil on the primary shunt core only and connecting it in series with at least part of the secondary coil; the voltage output of such a compensating coil is found to decline slowly with increasing input voltage, so that compensation is obtained by addition of outputs rather than by the substraction of a bucking coil with a consequent improvement in efficiency.

It will be evident that the cross-sections of the different cores can be chosen independently at will to suit particular requirements and that the sizes of the gaps in the discontinuous cores (when two are used) can also be chosen independently, and this allows further improvements in efficiency over and above that due to use of the more efficient grain-oriented material. The most efficient cores in accordance with the invention are capable of producing more than twice the output power of an otherwise equivalent constant voltage transformer of the same weight having a stack-type core.

Because C-type cores are already manufactured in a great variety of sizes, and much of the manufacturing machinery can be adjusted to produce a range of sizes, no tooling cost is involved in producing new designs of constant voltage transformer in accordance with the invention.

The constant-voltage transformer in accordance with the invention operates in substantially the same manner as the conventional apparatus with stack-type cores, but because the discontinuous cores used in the invention never operate in the saturation region there is a small difference in the range of output wave-forms that can be obtained. Typically it is found that for discontinuous cores of the same cross-sectional area the best approximation to a sinusoidal output wave-form is obtained if the gap in the primary shunt is significantly larger than the gap in the secondary shunt, for example four times as large.

The invention will be further described, by way of example, with reference to the accompanying drawings, in which.

Figure 1:
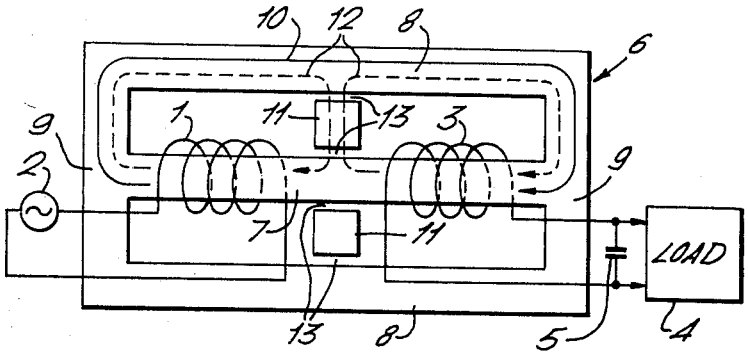
FIG. 1. PRIOR ART
FIG. 1 is a diagram illustrating a conventional prior-art constant voltage transformer.

As shown in FIG. 1, the known form of constant-voltage transformer includes a primary coil 1 connected to a power source 2 such as the A.C. mains supply and a secondary coil 3 connected to the load; a capacitor 5 in parallel with the load 4 tunes the secondary coil 3. The coils 1 and 3 are directly linked by a magnetic core 6 comprising a central limb 7 on which the coils are wound and two outer limbs 8 joined together by yokes 9 to define a direct magnetic flux path 10. Two shunt members 11 of magnetic material interconnect the central limb 7 and the outer limbs 8 at a point between the two coils 1, 3, to provide shunt paths 12; it is to be noted that non-magnetic air gaps 13 are provided in these shunt paths, but that independent control of the gaps in the two shunt paths is not available.

Figure 2:
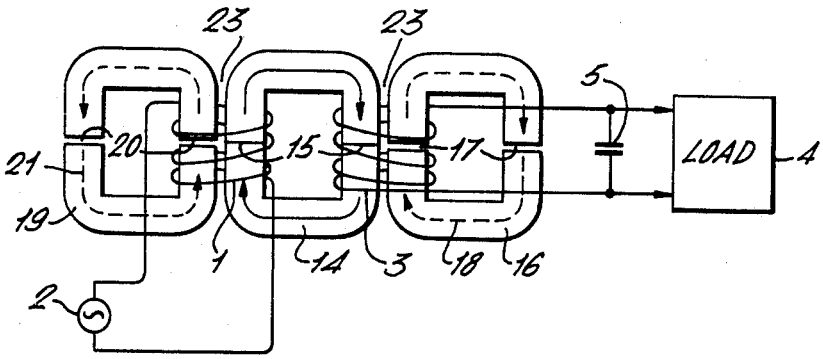
FIG. 2 is a diagram and FIG. 3 a perspective view of a first form of constant-voltage transformer in accordance with the invention.
Figure 3:
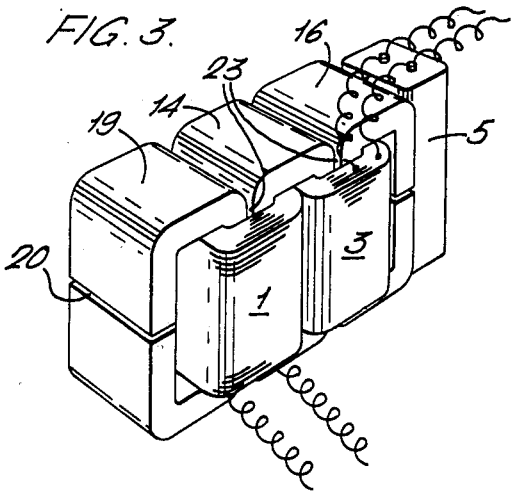

In the constant-voltage transformer shown in FIGS. 2–3 the primary and secondary coils 1 and 3 are directly linked by a first C-type magnetic core 14 having butt joints 15. A second C-type magnetic core 16, assembled with spacers to form non-magnetic gaps 17, acts as a shunt for the secondary flux 18. A similar third C-type core 19 with non-magnetic gaps 20 acts as a shunt for the primary flux 21.

Figure 4:
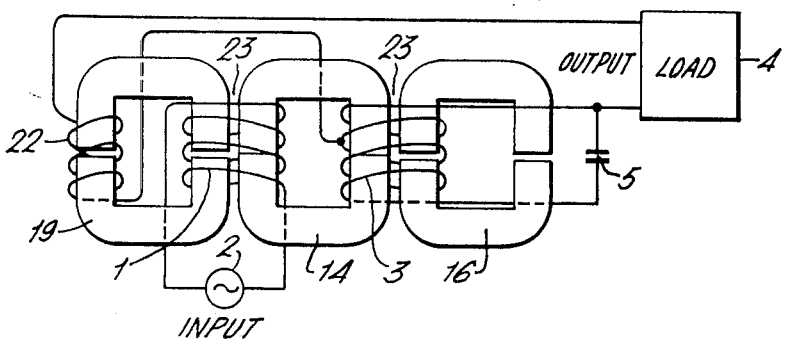
FIG. 4 is a diagram, similar to FIG. 3, illustrating an improved form of the invention.

FIG. 4 shows a modified and preferred form of constant-voltage transformer in which the output current, instead of being taken directly from the secondary coil 3, is modified by using a compensating coil 22 linked only by the third (primary shunt) C-type magnetic coil 19. This compensation coil is connected in series with a tapping on the secondary coil 3, as shown.

In both of the constant-voltage transformers illustrated, the three magnetic cores are spaced apart to form small gaps 23; if they touched, heat would be generated and efficiency reduced.

Figure 5:
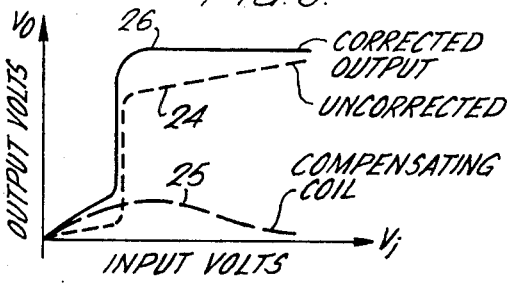
FIGS. 5 – 7 are graphs illustrating the characteristics of the constant-voltage transformers of the invention.
Figure 6:
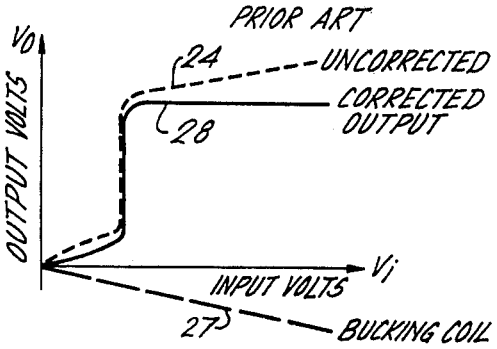
FIG. 6. PRIOR ART

FIG. 5 is a graph of output volts $V_o$ against the voltage $V_i$ applied to the primary coil 1; curve 24 shows the voltage output (under constant design load) of the secondary coil 3 itself, curve 25 the voltage output of the compensation coil 22, and curve 26 the compensated output supplied to the load. For comparison, FIG. 6 is an equivalent graph illustrating the conventional technique of compensation using a bucking coil with output curve 27 wound with the primary coil and opposing the output of the secondary coil to obtain a compensated output voltage curve 28 always less than the uncorrected curve 24.

Figure 7:
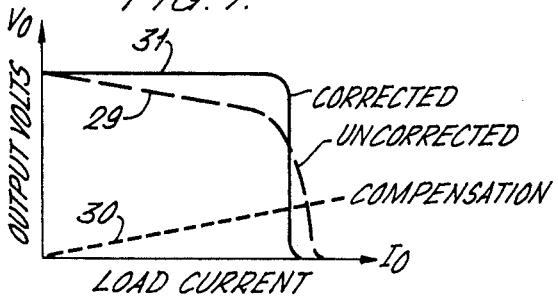

FIG. 7 is a graph of output voltage $V_o$ against load current $I_o$, for constant input voltage. Curve 29 shows the voltage obtained from the secondary coil 3 and curve 30 the voltage obtained from the compensation coil 22; these are combined to give an output voltage curve 31. It will be observed that the compensating coil voltage increases slowly with the load current, compensating the decrease in the secondary voltage, so that the output voltage remains substantially constant until an abrupt cut-off is reached, above which no appreciable voltage can be obtained. Thus this form of the invention creates the valuable possibility of making a transformer that is incapable of producing an output current in excess of a limit only slightly above its normal load current.

EXAMPLE 1

A constant-voltage transformer in accordance with the invention rated at 150 watts output providing a nearly sinusoidal output of $140 \pm 1.5$ V at 50 Hz when fed from the public supply mains at $230 \pm 30$ V at the same frequency comprises a primary coil of 964 turns of 0.25 $mm^2$ enamelled copper wire, a secondary coil of 482 turns of 0.4 $mm^2$ enamelled copper wire tapped at 250 turns tuned by a 28 microfarad capacitor, and a bucking coil of 140 turns of 0.4 $mm^2$ copper wire connected in series with the secondary coil.

The three coils are linked by a standard C-type oriented silicon-iron magnetic core having an iron cross section of 613 $mm^2$ and a substantially rectangular window measuring $63 \times 22$ mm; this core has two planar closely bonded cemented joints. A primary shunt core, generally coplanar with the main core and spaced 1 mm from it along one limb, on which limb the primary coil and the bucking coil are wound, takes the form of another C-type core having an iron cross-section of 200 $mm^2$ and a substantially rectangular window measuring $63 \times 16$ mm; this core has two planar joints which are gapped by a non-magnetic insulating spacer 1 mm thick inserted between the adjacent faces of the core parts. A secondary shunt core is symmetrically located and is identical with the primary shunt core except that its joint spacers are 0.3 mm thick. This example is of the form illustrated by FIGS. 2–3.

EXAMPLE 2

A second example displaying improved regulation and limiting of the output current, with a rating of 70VA includes a primary of coil of 1100 turns of 0.125 $mm^2$ enamelled copper wire, a secondary coil of 900 turns of 0.25 $mm^2$ enamelled copper wire tapped at 350 turns, and a compensating coil of 100 turns of 0.025 $mm^2$ wire. An 8 microfarad capacitor is connected across the secondary coil, the output being taken from the tapping, via the compensation coil connected in series.

The primary and secondary coils are linked by a standard grain oriented silicon iron C-core, having a rectangular window $67 \times 19$ mm and a cross sectional area 345 $mm^2$; the two halves of this core are closely held together so as to leave no gap between the cut faces. An identical core is linked through the secondary winding only to act as a secondary shunt, but 0.5 mm thick non-magnetic spacers are included between the cut faces to establish an air gap.

A similar core, but with a reduced cross section of 285 $mm^2$, is assembled as a primary shunt linking the primary with the compensating coil. This core also has a non-magnetic spacer of 1.5 mm thickness interposed between the halves. The primary shunt and the secondary shunt are each spaced apart 1 mm from the main core. The form of this example is illustrated by FIG. 4.

This constant voltage transformer, when connected to a supply of between 180 and 250 volts, 50 Hz, will maintain an output of between 109 and 111 volts for any load current up to 0.6A. At about 0.7 amps the output voltage is suddenly reduced so that the load current will not rise above 0.8 amps even when the output terminals are short-circuited.

What I claim as my invention is:

1. A constant-voltage transformer comprising a primary coil, a secondary coil, a tuning capacitor connected across said secondary coil, a magnetically continuous magnetic core linking both said primary coil and said secondary coil, a magnetically discontinuous magnetic core linking said secondary coil but not said primary coil and another discontinuous magnetic core linking said primary coil but not said secondary coil.

2. A constant-voltage transformer comprising a primary coil, a secondary coil, a tuning capacitor connected across said secondary coil, a magnetically continuous magnetic core linking both said primary coil and said secondary coil, a first magnetically discontinuous magnetic core linking said secondary coil but not said primary coil, and a second discontinuous magnetic core linking said primary coil but not said secondary coil, each said magnetic core being formed of curved laminations of grain-oriented material.

3. A constant-voltage transformer as claimed in claim 2 in which said continuous core is a C-type core with its parts closely butted and each of said first and second discontinuous cores is a C-type core with its parts butted on a spacer.

4. A constant-voltage transformer as claimed in claim 2 in which each said discontinuous core is spaced from said continuous core.

5. A constant-voltage transformer as claimed in claim 2 in which said primary and secondary coils are located on opposite legs of said continuous magnetic core.

6. A constant-voltage transformer as claimed in claim 2 in which each said discontinuous magnetic core is located outside said continuous magnetic core.

7. A constant-voltage transformer as claimed in claim 2 in which all of said magnetic cores are coplanar.

8. A constant-voltage transformer comprising a primary coil, a secondary coil, a tuning capacitor connected across said secondary coil, a magnetically continuous magnetic core linking both said primary coil and said secondary coil, a first magnetically discontinuous magnetic core linking said secondary coil but not said primary coil, a second discontinuous magnetic core linking said primary coil but not said secondary coil, and a compensating coil linked by said second discontinuous magnetic core only and connected in series with at least part of the secondary coil.

9. A constant-voltage transformer as claimed in claim 8 in which all of said magnetic cores are formed of curved laminations of grain-oriented material.

10. A constant-voltage transformer as claimed in claim 9 in which said continuous core is a C-type core with its parts closely butted and each discontinuous core is a C-type core with its parts butted on a spacer.

* * * * *